United States Patent [19]

Wanner

[11] 4,427,113

[45] Jan. 24, 1984

[54] MUSICAL INSTRUMENT CASE

[76] Inventor: John H. Wanner, 4833 W. Washington, Las Vegas, Nev. 89107

[21] Appl. No.: 298,900

[22] Filed: Sep. 2, 1981

[51] Int. Cl.[3] ..... A45C 11/24; A45C 11/00; B65D 85/00

[52] U.S. Cl. ..... 206/314; 206/216; 220/23

[58] Field of Search ..... 206/216, 314, 305, 317, 206/446; 220/23

[56] References Cited

U.S. PATENT DOCUMENTS

| | | | |
|---|---|---|---|
| 270,640 | 1/1883 | Cundy | 206/314 |
| 773,061 | 10/1904 | Cohen | 206/314 |
| 1,888,927 | 11/1932 | Lang | 206/314 |
| 1,900,718 | 3/1933 | Lang | 206/314 |
| 3,203,298 | 8/1965 | Sumrall | 206/314 X |
| 3,901,384 | 8/1975 | Lee et al. | 206/314 |
| 4,136,726 | 1/1979 | Lee | 150/52 J |
| 4,190,152 | 2/1980 | Reiter | 206/314 |

FOREIGN PATENT DOCUMENTS

| | | | |
|---|---|---|---|
| 2642070 | 9/1976 | Fed. Rep. of Germany | 206/314 |
| 2642132 | 9/1976 | Fed. Rep. of Germany | 206/314 |

*Primary Examiner*—William T. Dixson, Jr.
*Assistant Examiner*—Brenda J. Ehrhardt
*Attorney, Agent, or Firm*—Lerner, David, Littenberg, Krumholz & Mentlik

[57] ABSTRACT

A musical instrument case for wind instruments providing a body having an instrument storage chamber formed therein. The instrument is placed into the storage chamber through a mouth, a lid being provided to cover the mouth and at the same time to be inserted into the bell of the instrument to secure the same in position. A storage chamber can be provided in the lid and the body is tapered to conform on the inside thereof as well as on the exterior thereof substantially to the shape of the instrument to be stored.

35 Claims, 7 Drawing Figures

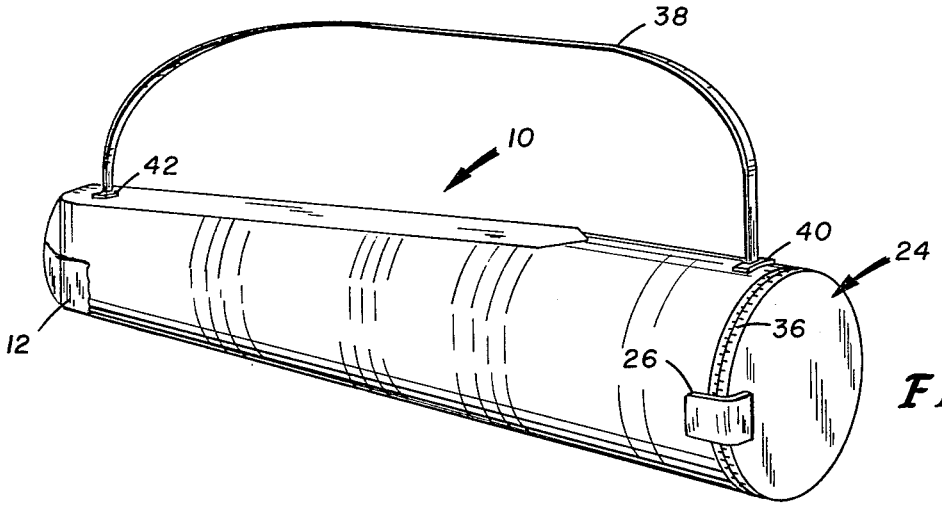
FIG. 1
FIG. 2
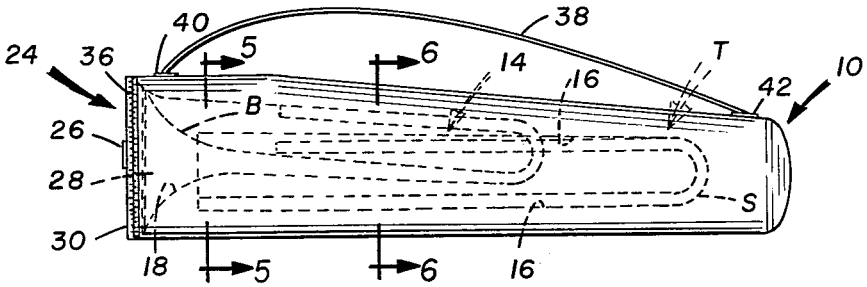
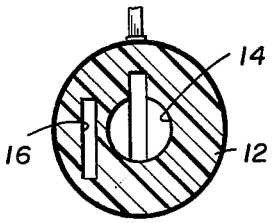
FIG. 5
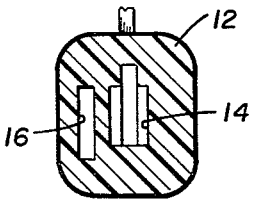
FIG. 6
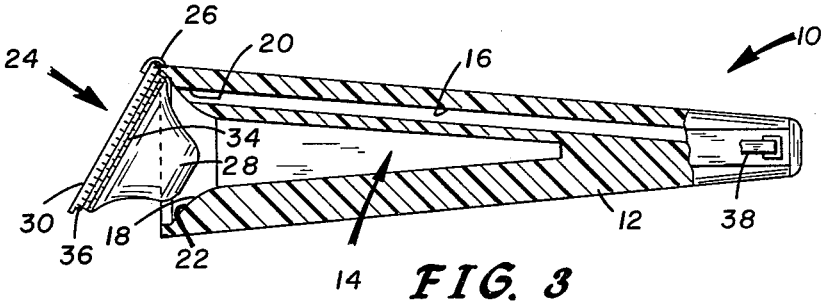
FIG. 3
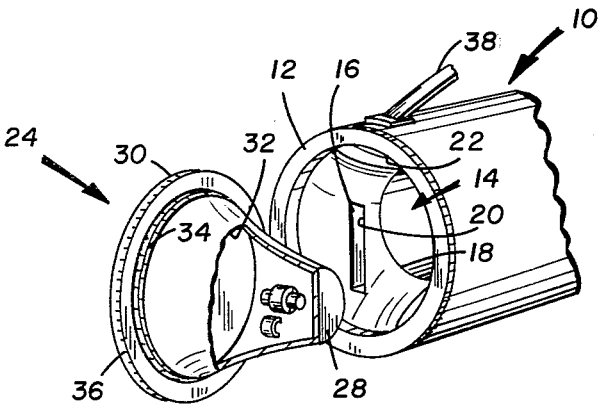
FIG. 4
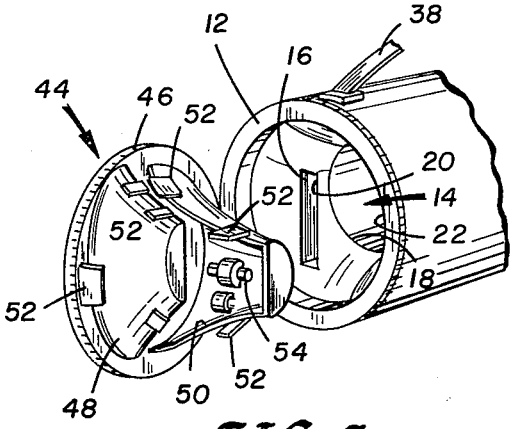
FIG. 7

MUSICAL INSTRUMENT CASE

BACKGROUND AND/OR ENVIRONMENT OF THE INVENTION

1. Field of the Invention

The present invention relates to musical instrument cases, and more particularly to a musical instrument case for carrying wind instruments having bells such as, but not limited to, trombones, trumpets, bugles, and clarinets.

2. Description of the Prior and/or Contemporaneous Art

U.S. Pat. Nos. 270,640 issued to W. H. Cundy on Jan. 6, 1883; 773,061 issued to H. Cohen on Oct. 25, 1904; 1,888,927 issued to A. S. Lang on Nov. 22, 1932; and 1,900,718 issued to A. S. Lang on Mar. 7, 1933 disclose conventional musical instrument carrying cases which, as almost all other cases in the art, generally fall into two classes. One class includes the type of musical instrument bag shown in Cohen. Such a bag is often referred to by musicians as a "gig bag". This type of bag or case has been popular for years among trombone players who found this type of form fitting case, sometimes fabricated of vinyl, light and easy to carry. The soft feel and appearance of the gig bag is also an appealing feature. Unfortunately, the gig bag provides little protection for an instrument stored therein against denting and springing, that is, disturbing the alignment of the slide of an instrument like a trombone. Also, because of its construction causing an instrument disposed therein to be vulnerable, a gig bag is generally carried under the arm of the user to protect the instrument, a quite uncomfortable requirement.

The other class of musical instrument cases known in the art is the rigid conventional, inevitably square cornered factory case which generally protects the instrument disposed therein, especially the slide in the case of a trombone, but which is heavy, bulky, and significantly less attractive than the aforenoted gig bag. An advantage of such a case is the room for storage of various items necessary for a musician.

Until the teachings of the present invention, features which greatly enhance the utility of either type of instrument case have not been provided or suggested in the art. The present invention provides a musical instrument case which incorporates, through unique structure, the advantages of both types of musical instrument cases and entirely avoids their disadvantages. In addition, the present invention provides a musical instrument case which is attractive, which protects the instruments stored therein, and which incorporates a hollow lid which serves as a sole means for access to the instrument case as well as storage means for storing desired items.

SUMMARY OF THE INVENTION

Therefore, a primary object of the present invention is to provide an instrument carrying case of solid and impact resistent construction which protects a musical instrument disposed therein while providing an appearance suggestive of a gig bag.

A further object of the present invention is to provide a musical instrument carrying case which is structured to be opened and closed solely by a lid which is contoured to fit snugly within the bell of the instrument disposed within the case.

A still further object of the present invention is to provide a musical instrument carrying case wherein the lid thereof is hollow and therefore forms a storage compartment suitable for storage therein of accessories, such as mouth pieces, slide oil, and the like.

Still another object of the present invention is to provide a musical instrument carrying case which permits rapid storage and withdrawal of an instrument.

Still another further object of the present invention is to provide a musical instrument carrying case which adds little bulk to the instrument, is light, and yet strong enough to undergo treatment as luggage while entirely protecting the instrument disposed therein from damage to the slide, bell, or other such delicate element thereof.

Another further object of the present invention is to provide a musical instrument carrying case which includes a sling strap to enhance the convenience of carrying the case by placement of the strap over the shoulder of the user.

Another still further object of the present invention is to provide a musical instrument carrying case which incorporates a contoured, form fitting inner construction which snugly accommodates the various components of the instrument when placed therein.

Another still additional object of the present invention is to provide a musical instrument carrying case which is simple in design, relatively inexpensive to manufacture, rugged in construction, easy to employ, and efficient in operation.

These objects, as well as further objects and advantages of the present invention, will become readily apparent after reading the ensuing description of the nonlimiting illustrative embodiments and viewing the accompanying drawing.

A musical instrument case for storage of an instrument having a bell at one end thereof according to the principles of the present invention comprises a body forming a storage compartment therein, the storage compartment forming a mouth, a portion of the instrument for total insertion in the storage compartment with the bell of the instrument residing proximate to the mouth of the storage compartment; and a lid for selectively opening and closing the mouth of the storage compartment, the lid being shaped to fit substantially within the bell of the instrument when the lid closes the mouth.

BRIEF DESCRIPTION OF THE DRAWING

In order that the present invention may be more fully understood, it will now be described, by way of example, with reference to the accompanying drawing in which:

FIG. 1 is a pictorial representation in perspective of the present invention;

FIG. 2 is a side view of the present invention with an instrument, shown in phantom, disposed therein;

FIG. 3 is a partially broken away top plan view of the present invention;

FIG. 4 is a fragmentary partially broken away view in perspective of the lid and mouth portion of the present invention;

FIG. 5 is a cross sectional view of the present invention taken substantially from the lines 5—5 of FIG. 2;

FIG. 6 is a cross sectional view of the present invention taken substantially from the lines 6—6 of FIG. 2; and FIG. 7 is a fragmentary partially broken away view in perspective of the lid and mouth portion of an alternate embodiment of the present invention.

DESCRIPTION OF THE PREFERRED EMBODIMENTS

Referring now to the figures, and more particularly to FIGS. 1 through 4 thereof, there is illustrated therein a musical instrument case 10 incorporating the features of the present invention. The case 10 is formed and dimensioned to accommodate a trombone therein, but through minor changes in dimensioning and minor structural modifications, well within the skill of one of ordinary skill in the art, such design can be modified to accommodate the carrying of a trumpet, bugle, baritone horn, clarinet, or other such wind instrument including a bell portion within the scope and principles of the present invention. Therefore, the illustrated musical instrument case 10 will be discussed in conjunction with a trombone merely for purposes of illustration with it being understood that the teachings are equally applicable to cases for other instruments.

The case 10, as illustrated, is constructed of a solid shock absorbing and/or dissipating material which is relatively rigid and forms a unitary body 12. Such materials include fiber glass and various compositions of plastics and materials such as polycarbonates and nylons. The body 12 can be finished on the exterior surfaces thereof in any suitable manner, but preferably is covered by a soft durable material such as leather or a suitable vinyl imitation thereof or the like.

The unitary body 12 forms therein instrument storage compartments 14 and 16. Storage compartments 14 and 16 are sized to accommodate a trombone as aforenoted, but can easily be otherwise dimensioned. Similarly, the incorporation of two storage compartments is merely illustrative and does not preclude the use of more or less storage compartments as desired. However, in the instance of a trombone, it is expedient to separate the slide from the bell and store these components separately. Additionally, the compartments 14 and 16 are contoured and tapered to conform substantially to the outer shape and dimensions of the trombone T when it is disposed within the compartments 14 and 16 as illustrated in FIG. 2.

With specific reference to FIG. 2, there is illustrated therein the trombone T disposed in the case 10. The bell portion B of the instrument T fits snugly against the body portion 28 of the lid 24 as a result of the dimensioning, contouring, and shaping thereof. In a like manner, the storage compartment 14 is tapered and contoured to snugly receive the bell portion B of the instrument T therein. The slide portion S of the instrument T is disposed within the storage compartment, the storage compartment 16 being contoured to snugly receive the same therein. The contours of compartments 14 and 16 are further illustrated in FIGS. 5 and 6. Because of the manner in which the body portion 12 of the present invention is formed, the storage compartments 14 and 16 can be provided, when manufactured, in various other shapes to accommodate different instruments. A prominent feature of each of these storage compartments 14 and 16 is that only at the mouths 18 and 20, respectively, thereof are these compartments accessible and open for insertion of an instrument therein. The mouths 18 and 20 merge and coincide with the mouth 22 of the body 12. These mouths 18 and 20, as illustrated, are the only openings, respectively, of the compartments 14 and 16.

Because of the unitary construction of the body 12 and the particular materials employed, the outer dimensions can be such that they approximate a generalized streamlined appearance of a contained instrument as is the case with a conventional gig bag. The body 12 when constructed of the suitable material hereinbefore noted will possess the necessary rigidity yet will be light in weight and will be suitable for shaping, tapering, and contouring by machining, molding, or other techniques well known in the art.

The mouth 22 of the body 12 and therefore the mouths 18 and 20, respectively, of the storage compartments 14 and 16 are opened and closed by a lid 24. The lid 24, as illustrated, is affixed to the body 12 by a strap type hinge 26. Of course, other types of hinges may be employed. The lid 24 includes a body portion 28 and a lid portion 30. The body portion 28 is tapered and contoured so that it may reside substantially within the bell B of the trombone T when the lid is in position over the mouth 22 as illustrated in FIG. 2. This aids in fixing the position of the bell B of the trombone T within the case 10. The body portion 28 of the lid 24 forms a storage chamber 32 therein. The cover portion 30 is preferably constructed of a rigid material and the body portion 28 can also be constructed of a rigid material or of a soft material so as to form a pouch. The body portion 28 is illustrated affixed to the cover portion 30 by a zipper 34 although other suitable affixing means can be provided. For instance, the body portion 28 can be fixedly secured by an adhesive or the like to the cover portion 30 and an opening formed in the body portion can provide access to the storage chamber 32, a suitable closure means such as snaps, buttons, Velcro, a zipper, or the like being provided on the opening for the closure thereof. The lid 24 is secured over the mouth 22 of the body 12 as illustrated in FIG. 4 by a zipper 36, one set of the teeth of the zipper 36 being disposed about the peripheral edge of the lid 24, the other complementary set of teeth of the zipper 36 being disposed about the mouth 22 of the body 12. Similarly, instead of the zipper 36, other suitable means may be provided such as buttons, clasps, snaps, hooks, Velcro, or other conventional securing means well known in the art.

With specific reference to FIG. 3, the case 10 is illustrated in an open position with the lid 24 slightly ajar from the mouth 22 of the body 12. Here, as in FIG. 4, it can be seen that the zipper 36 comprises two sets of complementary teeth, one set circumscribing the edge of the mouth 22, and the other complementary set circumscribing the edge of the lid 24. When the lid 24 is rotated on the strap hinge 26, so that the two sets of teeth are adjacent to each other, the zipper 36 can be closed. As previously discussed, any suitable arrangement for affixing the lid 24 to the body 12 can be employed and, if desired, a zipper or other suitable fastener can constitute the entire affixing means. If for instance, the lid 24 was affixed to the case body by a plurality of straps or snap clips, in such a case, the lid could be entirely removed from the case body as desired. . Such modifications are well within the skill of one of ordinary skill in the art.

An important feature of the present invention is the isolation which the compartments 14 and 16 provide for an instrument disposed therein. Specifically viewing FIG. 3, it can be seen that complete isolation of these chambers is possible and, because of the contouring of the chambers, the instrument parts disposed therein, as illustrated in FIG. 2, are snugly and securely maintained into position while being completely isolated from possible damage.

FIG. 7 shows an alternate embodiment of the present invention wherein a lid 44 is provided affixed to a body portion 12. The lid 44 includes a cover portion 46 and a hollow body portion 48 which forms a storage chamber 50 therein. The body portion 48 comprises two rigid halves which are mated together and secured by straps 52. The straps 52 mate to each other and to the cover portion 46 through use of any suitable means such as snaps, clips, Velcro or the like. When the halves of the body portion 48 are separated, access to the interior storage chamber 50 thereof is provided. If desired, the two halves of the body portion 48 could be hingedly secured to the cover portion 46 to fix the same in position. The storage chamber 50 as the storage chamber 32 of FIGS. 1 through 4, is provided for storage of various paraphernalia such as mouth piece 54. Additionally, slide cream, slide spray, valve spray, valve oil, or the like, not illustrated, can be stored in these storage chambers. Pockets, pouches, elastic straps, or the like may be provided to secure these items in position within the storage chamber.

To facilitate carrying of the case 10, a sling 38 is provided. The ends 40 and 42 of the sling 38 are fixedly secured to the body 12 in any suitable manner. The exact placement of the ends 40 and 42 is selected so that the proper balance of the case 10 is provided for the easy carrying thereof by the user. Alternately, a sling may be provided in the form of a loop with the ends thereof affixed to the case 10 at a common point either on the body 12 or the lid 24.

To insert an instrument into the case 10, the lid 24 is opened as illustrated in FIGS. 3 and 4. For a single piece instrument, like a trumpet, the instrument is inserted, bell last, into the storage compartment of the body of the case through the mouth thereof. Once the instrument is secure and in position, the lid is closed so that its body portion resides within the bell portion of the instrument and the cover portion of the lid portion is then fastened in position to the body of the case. For a two piece instrument, such as trombone T illustrated in FIG. 2, the slide portion S thereof is disposed in the storage compartment 16 and then the bell portion B of the trombone is placed in the storage compartment 14, with the bell portion thereof resting in the mouth 22. The lid 24 is then placed in position so that the body portion 28 thereof resides within the bell portion B and the lid 24 is then affixed to the body 12.

It should be understood that various changes in the details, materials, arrangements of parts, and operational conditions which have been herein described and illustrated in order to explain the nature of the invention may be made by those skilled in the art within the principles and scope of the invention.

Having thus set forth the nature of the invention, what is claimed is:

1. A musical instrument case for storage of an instrument having a bell at one end thereof comprising:

a body forming a storage compartment therein, said storage compartment forming a mouth, a portion of said instrument for total insertion in said storage compartment with said bell residing proximate to said mouth, said mouth being dimensioned to substantially conform in size to the portion of said bell disposed adjacent thereto when said musical instrument is disposed in said storage compartment, said mouth being the sole opening for insertion of said instrument in said storage compartment; and a lid for selectively opening and closing said mouth of said storage compartment, said lid being shaped to fit substantially within said bell of said instrument when said lid closes said mouth.

2. A musical instrument case in accordance with claim 1, wherein said lid forms a storage chamber therein, access to said storage chamber being selectively provided.

3. A musical instrument case in accordance with claim 2, wherein said lid comprises a hollow body portion shaped to fit substantially within said bell of said instrument and a cover portion, said body portion forming said storage chamber therein, said access to said storage chamber being provided by separation of said cover portion from said body portion.

4. A musical instrument case in accordance with claim 3 further comprising means for selectively securing said body portion to said cover portion.

5. A musical instrument case in accordance with claim 4, wherein said selective securing means comprises a zipper.

6. A musical instrument case in accordance with claim 3, wherein said body portion is divided into two sections, said sections being selectively separable to aid in said access to said storage chamber, said body portion further comprising means for selectively joining said sections.

7. A musical instrument case in accordance with claim 1, wherein said body is unitary in construction.

8. A musical instrument case in accordance with claim 7, wherein said storage compartment is contoured and shaped to conform substantially to the shape of said instrument to be disposed therein.

9. A musical instrument case in accordance with claim 2, wherein said body is constructed of a shock absorbing material, the exterior thereof and the exterior of said lid being covered in a durable soft material.

10. A musical instrument case in accordance with claim 1, wherein said body forms at least one additional storage compartment, each of said at least one additional storage compartments opening into said mouth of said body.

11. A musical instrument case in accordance with claim 10, wherein each of said at least one additional storage compartments are contoured and shaped to conform substantially to the shape of said instrument to be disposed therein.

12. A musical instrument case in accordance with claim 1 further comprising means for selectively mounting said lid to said body over said mouth.

13. A musical instrument case in accordance with claim 12, wherein said selective mounting means comprises at least one fastener.

14. A musical instrument case in accordance with claim 13, wherein said fastener comprises a zipper having two sets of complementary teeth, one set of complementary teeth being operably disposed about the peripheral edge of said lid, the other set of complementary teeth being operably disposed about the mouth of said body.

15. A musical instrument case in accordance with claim 13, wherein said selective mounting means further comprises hinge means for hingedly affixing said lid to said body.

16. A musical instrument case in accordance with claim 1 further comprising a strap fixedly secured on the ends thereof to said case.

17. A musical instrument case in accordance with claim 1, wherein the exterior of said body is contoured and shaped to approximate the general shape of the instrument to be contained therein.

18. A musical instrument case for storage of an instrument having a bell at one end thereof comprising:

a body forming a storage compartment therein, said storage compartment forming a mouth, a portion of said instrument for total insertion in said storage compartment with said bell residing proximate to said mouth, said storage compartment being contoured and shaped to conform substantially to said instrument to be disposed therein, the exterior of said body being contoured and shaped to approximate the general shape of the instrument to be contained therein;

a lid for selectively opening and closing the mouth of said storage compartment, said lid comprising a hollow body portion and a cover portion, said hollow body portion being shaped to fit substantially within said bell of said instrument when said lid closed said mouth, said body portion forming a storage chamber therein, access to said storage chamber being selectively provided; and means for selectively mounting said cover portion of said lid to said body over said mouth thereof, said selective mounting means comprising at least one fastener and hinge means for hingedly affixing said lid to said body.

19. A musical instrument case for storage of an instrument having a bell at one end thereof comprising:

a body forming a storage compartment therein, said storage compartment forming a mouth, a portion of said instrument for total insertion in said storage compartment with said bell residing proximate to said mouth; and a lid for selectively opening and closing said mouth of said storage compartment, said lid being shaped to fit substantially within said bell of said instrument when said lid closes said mouth, said lid forming a storage chamber therein, said lid including a hollow body portion shaped to fit substantially within said bell of said instrument and a cover portion, said body portion forming said storage chamber therein, access to said storage chamber being selectively provided.

20. A musical instrument case in accordance with claim 19, further comprising means for selectively securing said body portion to said cover portion.

21. A musical instrument case in accordance with claim 20, wherein said selective securing means comprises a zipper.

22. A musical instrument case in accordance with claim 19, wherein said body portion is divided into two sections, said sections being selectively separable to aid in said access to said storage chamber, said body portion further comprising means for selectively joining said sections.

23. A musical instrument case in accordance with claim 19, wherein said body is unitary in construction.

24. A musical instrument case in accordance with claim 23, wherein said storage compartment is contoured and shaped to conform substantially to the shape of said instrument to be disposed therein.

25. A musical instrument case in accordance with claim 19, wherein said body is constructed of a shock absorbing material, the exterior thereof and the exterior of said lid being covered in a durable soft material.

26. A musical instrument case in accordance with claim 19, wherein said body forms at least one additional storage compartment, each of said at least one additional storage compartments opening into said mouth of said body.

27. A musical instrument case in accordance with claim 26, wherein each of said at least one additional storage compartments are contoured and shaped to conform substantially to the shape of said instrument to be disposed therein.

28. A musical instrument case in accordance with claim 19, further comprising means for selectively mounting said lid to said body over said mouth.

29. A musical instrument case in accordance with claim 28, wherein said selective mounting means comprises at least one fastener.

30. A musical instrument case in accordance with claim 29, wherein said fastener comprises a zipper having two sets of complementary teeth, one set of complementary teeth being operably disposed about the peripheral edge of said lid, the other set of complementary teeth being operably disposed about the mouth of said body.

31. A musical instrument case in accordance with claim 29, wherein said selective mounting means further comprises hinge means for hingedly affixing said lid to said body.

32. A musical instrument case in accordance with claim 19, further comprising a strap fixedly secured on the ends thereof to said case.

33. A musical instrument case in accordance with claim 19, wherein the exterior of said body is contoured and shaped to approximate the general shape of the instrument to be contained therein.

34. A musical instrument case for storage of an instrument having a bell at one end thereof comprising:

a body forming a storage compartment therein, said storage compartment forming a mouth, a portion of said instrument for total insertion in said storage compartment with said bell residing proximate to said mouth, said body being constructed of a shock absorbing material, the exterior thereof and the exterior of said lid being covered in a durable soft material; and a lid for selectively opening and closing said mouth of said storage compartment, said lid being shaped to fit substantially within said bell of said instrument when said lid closes said mouth, said lid forming a storage chamber therein, access to said storage chamber being selectively provided.

35. A musical instrument case in accordance with claim 34, wherein said lid comprises a hollow body portion shaped to fit substantially within said bell of said instrument and a cover portion, said body portion forming said storage chamber therein, said access to said storage chamber being provided by separation of said cover portion from said body portion.

* * * * *